US008388475B2

(12) United States Patent
Leefeldt

(10) Patent No.: US 8,388,475 B2
(45) Date of Patent: Mar. 5, 2013

(54) WATER SKIPPING GAME BAG

(76) Inventor: Timothy Leefeldt, Chico, CA (US)

( * ) Notice: Subject to any disclaimer, the term of this patent is extended or adjusted under 35 U.S.C. 154(b) by 201 days.

(21) Appl. No.: 12/983,457

(22) Filed: Jan. 3, 2011

(65) Prior Publication Data

US 2011/0165978 A1 Jul. 7, 2011

Related U.S. Application Data

(60) Provisional application No. 61/335,193, filed on Jan. 4, 2010.

(51) Int. Cl.
*A63B 43/00* (2006.01)

(52) U.S. Cl. ..... 473/594; 473/466

(58) Field of Classification Search ..... 473/594, 473/595, 601, 602, 466; 273/DIG. 20
See application file for complete search history.

(56) References Cited

U.S. PATENT DOCUMENTS

| | | | | | |
|---|---|---|---|---|---|
| 4,065,126 | A | * | 12/1977 | Mantz | 473/462 |
| 4,463,951 | A | | 8/1984 | Kumasaka | |
| 4,637,616 | A | * | 1/1987 | Whiting | 473/577 |
| 4,886,275 | A | * | 12/1989 | Walker | 473/280 |
| 5,026,054 | A | * | 6/1991 | Osher et al. | 473/594 |
| 5,848,946 | A | * | 12/1998 | Stillinger | 473/594 |
| 5,891,000 | A | * | 4/1999 | Phillips | 482/49 |
| 5,910,059 | A | | 6/1999 | Hanson | |
| 6,053,829 | A | * | 4/2000 | Conley | 473/594 |
| 6,059,676 | A | * | 5/2000 | Seymour et al. | 473/570 |
| 6,219,876 | B1 | * | 4/2001 | Blum | 15/215 |
| 6,287,226 | B1 | * | 9/2001 | Dilling | 473/594 |
| 6,322,465 | B1 | * | 11/2001 | Gentile | 473/594 |
| 6,585,555 | B2 | * | 7/2003 | Wong et al. | 446/153 |
| 7,559,862 | B2 | * | 7/2009 | Von Heland | 473/594 |
| 8,241,086 | B2 | * | 8/2012 | Kim | 446/369 |
| 2001/0014633 | A1 | * | 8/2001 | Moore | 473/466 |
| 2003/0220162 | A1 | * | 11/2003 | Quinn | 473/594 |
| 2007/0161439 | A1 | | 7/2007 | Huang | |
| 2008/0045364 | A1 | | 2/2008 | Von Heland | |
| 2008/0220915 | A1 | * | 9/2008 | Frazier | 473/594 |
| 2008/0242458 | A1 | * | 10/2008 | Winn | 473/599 |
| 2009/0312127 | A1 | * | 12/2009 | Kessler | 473/570 |

OTHER PUBLICATIONS

International Search Report and Written Opinion dated Sep. 26, 2011 from corresponding International Patent Application No. PCT/US2011/020024—7 pages.

* cited by examiner

*Primary Examiner* — Steven Wong
(74) *Attorney, Agent, or Firm* — Maier & Maier PLLC

(57) ABSTRACT

A water skipping game bag. The game bag can include a liquid-permeable cover having a hydrophobic exterior surface and enclosing an interior chamber, a liquid-permeable pouch disposed within the chamber, a filler material having fluid properties, and a liquid-absorbent core disposed within the pouch. The game bag can absorb water and deform so as to improve skipping performance, increase ease of catching and throwing the bag, and reduce the likelihood of injury from impact by the bag.

12 Claims, 1 Drawing Sheet

WATER SKIPPING GAME BAG

CROSS-REFERENCE TO RELATED APPLICATIONS

This application claims priority to U.S. Provisional Application 61/335,193, filed Jan. 4, 2010 and entitled WATER-BAG SUITABLE FOR WATERGAMES, the entire contents of which are hereby incorporated by reference.

BACKGROUND

Balls, game bags, and other small projectiles have been historically utilized for entertainment, sport, exercise and health purposes. Games involving throwing, kicking, and catching such objects, as well as aiming the objects towards goals or other people are known to increase hand-eye and foot-eye coordination, as well as provide pleasure and entertainment to the people involved in the game. Many games involving such objects also involve bouncing the object off a surface so as to modify the trajectory of the object.

Most such objects have been intended for use on dry land and are poorly adapted for use in pools, lakes, oceans, streams or other bodies of water. Those objects that are adapted for use on dry land typically possess poor flotation and water skimming characteristics and are thus not capable of bouncing or skimming on top of the water surface. When such objects come in contact with the water surface, the momentum of the object is absorbed by the water and thus the object comes to rest near the point of contact. Such behavior prevents the use of the water surface as a surface off which the object can be bounced or skipped, and reduces the enjoyability of water-oriented games.

Certain balls have been adapted for use on water. However, such balls typically have components that are water-impermeable and highly resilient. The use of such components results in the balls bouncing off the water at a high rebound rate, resulting in loss of control over the ball and the distance that the ball travels. Additionally, water-impermeable and highly resilient components result in low deformability of the ball upon impact, which can result in the ball being difficult to catch, erratic bouncing of the ball, and the ball being painful upon impact with human skin, especially for younger players. For example, a water-impermeable or highly resilient ball can bounce erratically and unpredictably off a solid surface and travel for a considerable distance, resulting in the ball leaving the proximate area, for example the surrounding pool deck or other field of play. Furthermore, water-impermeable components prevent such balls from altering their mass and density, resulting in degraded performance when in contact with the water surface. This can also result in excessive and erratic bouncing action, excessive speed, and excessive travel distance resulting in the ball leaving the field of play, and difficulty in catching the ball.

SUMMARY

According to at least one exemplary embodiment, a water skipping game bag is disclosed. The game bag can include a liquid-permeable cover having a hydrophobic exterior surface and enclosing an interior chamber, a liquid-permeable pouch disposed within the chamber, a filler material having fluid properties, and a liquid-absorbent core disposed within the pouch.

The game bag can have a generally spherical, deformable shape and a specific gravity of less than 1.0 relative to water. The filler material can include a plurality of pellets and have a specific gravity of less than 1.0. The liquid-absorbent core can have a specific gravity of less than 1.0 and can absorb water so as to increase the specific gravity of the core and alter the behavior of the game bag on the water surface.

The game bag can achieve a desired and unique skipping behavior on the water surface. The game bag can absorb water and deform so as to improve skipping performance, increase ease of catching and throwing the bag, and reduce the likelihood of injury from impact by the bag.

DETAILED DESCRIPTION

Figure 1:
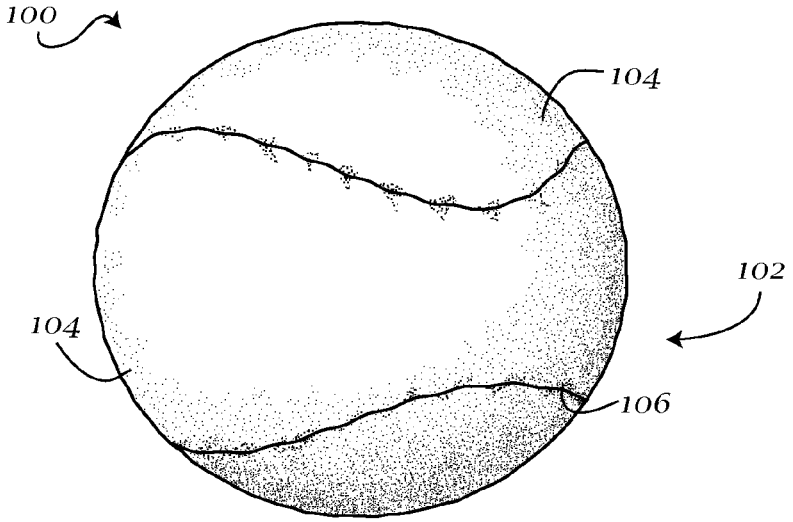
FIG. 1 is an isometric view of an exemplary embodiment of the game bag.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

According to at least one exemplary embodiment, a water skipping game bag 100 may be disclosed. Game bag 100 can include a cover 102 enclosing an inner chamber 150. Disposed within inner chamber 150 can be pellets 110 and water absorbent core 120. Pellets 110 and core 120 can further be contained within pouch 130, which can likewise be disposed within inner chamber 150.

Figure 2:
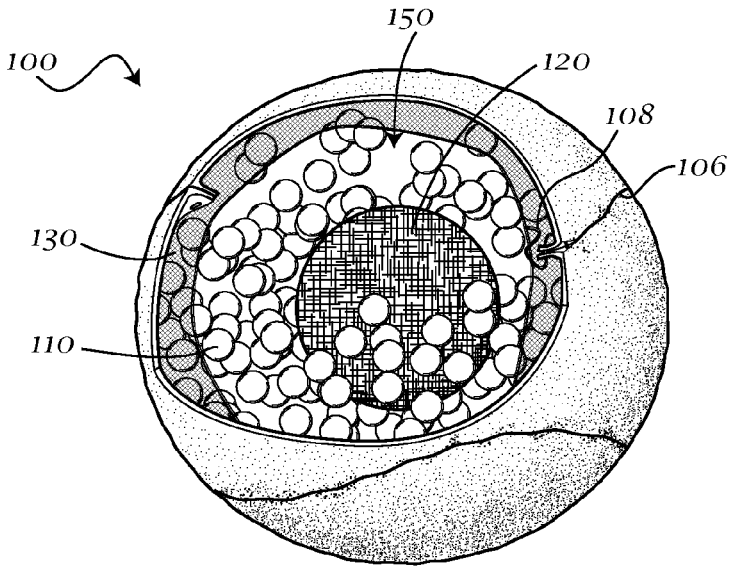
FIG. 2 is a cutaway view of an exemplary embodiment of the game bag, showing the interior structure of the exemplary embodiment.

FIGS. 1-2 show an exemplary embodiment of a water skipping game bag 100. Game bag 100 may have a generally spherical shape, and may be deformable or collapsible upon application of force to the game bag. Game bag 100 may have any other desired shape that enables game bag 100 to function as described herein, for example an oval shape, egg shape, pancake shape, and so forth. Game bag 100 may have a diameter of approximately 2 inches.

Game bag 100 may include a cover 102 enclosing an inner chamber 150. Cover 102 may include a plurality of portions 104 that may be joined together to form cover 102. The cover 102 can be flexible and stretchable so as to allow the shape of game bag 100 to deform upon impact and to conform to the shape of the surface against which game bag 100 is impacted. The deformability of cover 100 can allow game bag 100 to skip along the surface of the water and can facilitate easily gripping game bag 100 with one hand, for example when throwing or catching the game bag. Cover 102 can further be water-permeable and have a hydrophobic exterior surface, thereby allowing liquid to penetrate into interior chamber 150 while lowering the surface tension of the cover, thereby facilitating skipping game bag 100 on the water surface.

In one embodiment, cover 102 may include two portions 104 that are similarly or identically shaped and that can be joined together to fully enclose inner chamber 150 of game bag 100. In such an embodiment, the portions 104 may have a curvilinear shape, for example a figure-eight shape, and may be joined together such that there is a single seam 106 between the two portions 104. Portions 104 may be joined by any fastening method known in the art, for example with a thread 108, or by heat-sealing, chemically binding or adhesively binding the peripheries of portions 104. The seam between portions 104 can be formed such that, upon completion of assembly of cover 102, the peripheries of portions 104 are folded towards the interior of game bag 100 and the resulting seam 106 is disposed within the interior chamber of game bag 100. The result is that the thread 108 can be invisible or almost invisible from the outside of game bag 100, and such that the last stitch and thread can be tucked inside the game bag. Seam 106 is also thus protected from degradation by exposure to and friction with outside surfaces. Thread 108 may be any thread that can withstand repeated exposure to water, including salt water, as well as wet and dry cycles during use and storage of the game bag. Exemplary materials for thread 108 can include polyester, for example a medium polyester thread. Exemplary materials for thread 108 can also include nylon, a wax-sealed thread, or any other material that allows game bag 100 to function as described herein.

Minimizing the amount and length of the seams between the portions 104 of game bag 100 can facilitate minimizing the resistance of game bag 100 to skipping over the surface of the water. As such resistance increases with the amount and length of the seams present on the cover of game bag 100, the amount and length of the seams may be altered to achieve desired characteristics for game bag 100. Minimizing the amount and length of the seams between portions 104 can further facilitate imparting an irregular, deformable shape to game bag 100.

The material used to form cover 102 may be any durable, water-permeable material. Additionally, the material used to form cover 102 can be a hydrophobic material having low surface tension. Such low surface tension allow liquid to bead up on the surface of, and be repelled by, cover 102. In one embodiment, the material used for cover 102 may be ultra-suede. In other embodiments, the material used for cover 102 may be ultra-suede light ("facile"), micro-suede, suede, leather, as well as pigskin and deerskin. Cover 102 may further be coated with oils or waxes. Oils and waxes can facilitate protecting the material from which cover 102 is formed from exposure to substances such as chlorine or salt water, and can also facilitate protecting cover 102 from drying out when game bag 100 is in storage. Additionally, oils and waxes can facilitate increasing the hydrophobicity and decreasing the surface tension of cover 102.

Disposed within cover 102, in interior chamber 150 of game bag 100 may be a filler material. The filler material can include a plurality of pellets 110. Pellets 110 may be sized so as to impart generally fluid properties to the filler material, including low resilience to impact, and easy deformability upon impact. Such properties can result in a slower impact response, also described as "slow acting on impact," thereby facilitating a decreased rebound rate of the game bag, facilitating the game bag skipping on water and modifying the shape of the game bag in response to contact with water, as well as facilitating easily catching the game bag. Furthermore, such properties facilitate the rapid dissipation of the game bag's momentum when the game bag contacts a solid surface, thereby limiting the distance that game bag 100 travels from the point of contact. For example, after impacting a solid surface such as a pool deck, game bag 100 may roll for a relatively short distance and come to a stop.

The fluid characteristics of the filler material may be facilitated by the size and configuration of pellets 110 and the material from which the pellets are formed. Pellets 110 can have a substantially spherical shape, or may be irregularly-shaped pellets that have a shape that approximates a spherical shape. While the spherical or substantially spherical shape imparts a fluidity to the filler material that best approximates true fluidic behavior, other shapes may be used for pellets 110. For example, pellets 110 may have an elongated shape, a discoidal shape, an oblate shape, or any other desired shape that allows game bag 100 to function as described herein. Sharp edges or ridges on the surface of pellets 110 can be minimized or subdued so as to allow pellets 110 to move freely past one another, thereby further facilitating fluid behavior for the filler material. Pellets 110 can have a diameter between approximately ¼ inch and 1/18 inch. In one embodiment, pellets 110 can have a diameter of approximately ⅛ inch. Additionally, pellets 110 can have a specific gravity with respect to water that is lower than 1.0, so as to facilitate game bag 100 floating on the surface of the water.

Pellets 110 may be formed from a material having a specific gravity that is between approximately 0.915 and 0.980 with respect to water. Such materials can include high-density polyethylene ("HDPE"), Surlyn® resin, manufactured by the DuPont company, Nylon, resin, or any other polymers or similar materials having a specific gravity within the above-indicated range. In one embodiment, pellets 110 may be formed from Surlyn® and have a specific gravity of approximately 0.970. In another embodiment, pellets 110 may be formed from HDPE and have a specific gravity between approximately 0.949 and approximately 0.970. In yet another embodiment, pellets 110 may be formed from medium density polyethylene, and have a specific gravity between approximately 0.938 and 0.947. In yet another embodiment, pellets 110 may be formed from low density polyethylene, and have a specific gravity between approximately 0.921 and 0.936. The particular specific gravity for pellets 110 may be selected as desired based on the desired behavior of game bag 100 with respect to the water surface.

The quantity of pellets 110 disposed within inner chamber 150 of game bag 100 may be such that the pellets constitute approximately three-quarters by volume of inner chamber 150. Such a quantity provides sufficient free space for water absorbing core 120, as well as sufficient free space to facilitate fluidic behavior of the filler material. Such a quantity further presents game bag 100 with a desired balance of game bag size, interior chamber volume, and pellet fill percentage of the interior chamber volume, thereby imparting desired "slow acting on impact" characteristics to game bag 100, as well as desired resilience and friction on the water surface.

Disposed within interior chamber 150 may be water absorbing core 120. Water absorbing core 120 can be formed from a porous material that is suitable for absorbing water. The porous material can provide additional mass to game bag 100, which can further be increased by absorbing water, thereby increasing the density of game bag 100 so as to achieve optimal performance. For example, water absorbing core 120 can be formed from polyisoprene having a specific gravity of approximately 0.300 relative to water. Water absorbing core 120 may further have a diameter of approximately one inch. As water is absorbed by core 120, the diameter of core 120 may increase by approximately 5%-7% of the original diameter. Water absorbing core 120 may have a weight of between approximately 3.0 grams and approximately 3.5 grams when dry. For example, water absorbing core 120 may have a weight of approximately 3.2 grams when dry. Water absorbing core 120 may further have a weight of between approximately 8.7 grams and approximately 9.5 grams when saturated. For example, water absorbing core 120 may have a weight of approximately 9.1 grams when saturated. The weight, diameter, and specific gravity of water absorbing core 120 may thus vary relative to the saturation level of the water absorbing core.

Water absorbing core 120 may further be formed from a material having good abrasive resistance characteristics, so as to adequately withstand the abrasion of pellets 110 upon the surface of core 120 and withstand the impacts of bag 100 against hard objects. For example, water absorbing core 120 may be formed from a rubber material having an elongation-to-break of between approximately 380% to approximately 440%.

In some embodiments, pellets 110 and water absorbing core 120 can be contained within a pouch 130 disposed within interior chamber 150 of game bag 100. Pouch 130 may be formed from a low-density, meshlike material that allows liquid to pass freely therethrough and that is resistant to mold and mildew. For example, pouch 130 may be formed from a nylon mesh fabric. The mesh may be sized so as to allow pouch 130 to contain the smallest of pellets 110 within pouch 130. Pouch 130 can facilitate protecting the interior of cover 102, seam 106 and thread 108 from the abrasion of pellets 110, and can also facilitate adding mass to game bag 100 by absorbing liquid. Pouch 130 may be constructed from any desired number of portions, for example, two circular halves, and may be joined in any desired manner, for example by stitching or by adhesive bond.

When dry, game bag 100 may have a weight between approximately 44 grams and approximately 47 grams. For example, game bag 100 may have a weight of approximately 45.7 grams when dry. When saturated, game bag 100 may have a weight between approximately 72 grams and approximately 76 grams. For example, game bag 100 may have a weight of approximately 73.9 grams when saturated.

The water absorption capacity of water absorbing core 120 and cover 102 may facilitate a desired rate of water transfer through game bag 100 while the game bag is in motion over the water surface. Such a rate of water transfer through game bag 100 can further facilitate maintaining the internal components of the game bag in fluid suspension as the game bag is traveling over the water surface. Furthermore, the behavior of game bag 100 may vary in relation to the saturation level of game bag 100. For example, the user can fully saturate game bag 100 so as to maximize its traveling distance and the number of times that the game bag can skip on the water surface. The user can also squeeze game bag 100 so as to reduce the amount of water contained therein, so as to reduce the traveling distance and number of skips of game bag 100.

Exemplary embodiments of a water skipping game bag are disclosed above. The game bag disclosed herein can achieve desired performance in water-oriented games and activities by skimming and skipping on top of the water surface. The game bag disclosed herein can exhibit a low profile skip pattern over the water surface. The components of the game bag and the physical properties and configurations thereof allow the game bag to achieve a dynamic balance between the components, thereby providing a game bag that freely absorbs and expels water, skips on top of the water surface, does not bounce on solid surfaces, and deforms upon impact.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A game bag, comprising:

a liquid-permeable cover having a hydrophobic exterior surface and enclosing an interior chamber;

a filler material having fluid properties disposed within the interior chamber, the filler material comprising a plurality of pellets, the pellets having a specific gravity of less than 1.0; and a liquid-absorbent core disposed within the interior chamber.

2. The game bag of claim 1, further comprising a liquid-permeable pouch disposed within the interior chamber and surrounding the filler material and the liquid-absorbent core.

3. The game bag of claim 1, wherein the pellets have a specific gravity between approximately 0.915 and approximately 0.980.

4. The game bag of claim 3, wherein the pellets have a specific gravity between approximately 0.949 and approximately 0.970.

5. The game bag of claim 1, wherein the pellets are formed from Surlyn.

6. The game bag of claim 1, wherein the pellets are formed from polyethylene.

7. The game bag of claim 1, wherein the liquid-absorbent core is porous.

8. The game bag of claim 1, wherein the liquid-absorbent core is formed from polyisoprene.

9. The game bag of claim 1, wherein the filler material constitutes approximately 75% by volume of the interior chamber.

10. The game bag of claim 1, wherein the liquid-absorbent core has a dry weight of between approximately 3.0 grams and approximately 3.5 grams, and a saturated weight of between approximately 8.7 grams and approximately 9.5 grams.

11. The game bag of claim 1, wherein:

the game bag exhibits skipping behavior along a water surface;

the game bag exhibits a low resilience; and the game bag exhibits a low rebound rate upon impact.

12. The game bag of claim 11, wherein the skipping behavior varies in relation to a saturation level of the game bag.

* * * * *